United States Patent [19]

Dunn, Jr.

[11] 4,233,064

[45] Nov. 11, 1980

[54] METHOD OF SCAVENGING STEEL

[76] Inventor: Edward J. Dunn, Jr., 101 B Village Round, Wescosville, Pa. 18106

[21] Appl. No.: 26,902

[22] Filed: Apr. 4, 1979

Related U.S. Application Data

[63] Continuation-in-part of Ser. No. 942,139, Sep. 13, 1978.

[51] Int. Cl.[3] ..... C21C 7/00; C21C 7/02; C21C 7/04

[52] U.S. Cl. ..... 75/58; 75/53; 75/93 G

[58] Field of Search ..... 75/53, 58, 93 G

[56] References Cited

U.S. PATENT DOCUMENTS

| | | | |
|---|---|---|---|
| 3,681,050 | 8/1972 | Ueki | 75/53 |
| 3,681,051 | 8/1972 | Takashima | 75/53 |
| 3,802,680 | 4/1974 | Anders | 75/53 |
| 3,865,577 | 2/1975 | Gottschol | 75/53 |
| 3,998,625 | 12/1976 | Koros | 75/53 |
| 4,040,818 | 8/1977 | Clegg | 75/53 |
| 4,083,716 | 4/1978 | Yoshida | 75/53 |
| 4,126,453 | 11/1978 | Heek | 75/53 |

*Primary Examiner*—P. D. Rosenberg
*Attorney, Agent, or Firm*—Barlow & Barlow

[57] ABSTRACT

The present invention relates to a more efficient method for adding lighter-than steel, low solubility, volatile, active scavenging agents into molten steel that reduces or eliminates the smoke that accompanies other methods of adding these agents.

20 Claims, No Drawings

METHOD OF SCAVENGING STEEL

CROSS REFERENCE TO RELATED APPLICATION

This application is a continuation-in-part of application Ser. No. 942,139, filed Sept. 13, 1978.

BACKGROUND OF THE INVENTION

Impurities such as sulfur, oxygen, phosphorous, and carbon are known to effect the processing, as well as the mechanical and physical properties of steel, nickel, and cobalt alloys.

For example, sulfur causes hot shortness; oxygen causes edge cracking; while sulfur and oxygen cause surface imperfections; all of which effect the yield and costs of steel manufacture.

In addition, sulfur and oxygen are known to reduce ductility and toughness; sulfur, oxygen and phosphorous are known to lower the ductile-brittle transition temperatures, and, forming characteristics; while sulfur, oxygen, phosphorous, and carbon are known to detract from soft magnetic characteristics of steels and alloys.

Because of the increasing awareness for the need to control and eliminate these impurities in steel, a great deal of activity has been focused on developing systems or techniques that fill this need. Calcium and magnesium are both excellent deoxidizers and desulfurizers, and as such some of the work has focused on these elements and has resulted in patented calcium, and magnesium alloy additives; pneumatic injection systems, and, submersion techniques for adding calcium, magnesium and their alloys.

This invention relates to a submersion technique for adding solid shapes of lighter-than-steel, volatile, low soluble, purifying agents such as calcium, and magnesium into molten steel.

Both magnesium and calcium are lighter-than-steel, have limited solubility, and boil at temperatures lower than molten steel. A possible way to add lighter-than-steel material is via some sort of submersion technique. However, because these elements boil at low temperatures and have limited solubility, rapid vaporization occurs as they are added to liquid steel, and that which is not immediately consumed by the steel rushes to the surface of the steel causing metal eruptions and/or violent explosions, flare, and, smoke. Thus, something other than simple submersion techniques are required to avoid these problems.

Prior art teaches a variety of submersion techniques which include pneumatic injection systems for adding calcium and magnesium in fine grain particulate form U.S. Pat. No. 3,998,625, and U.S. Pat. No. 4,123,258 as well as the use of containers U.S. Pat. No. 2,915,386 for protecting such additions from contact with the molten ferrous metal until some time after the container with the treating agent is submerged, or covered, by the molten metal. In one case, a cylinder containing the treating agent is submerged U.S. Pat. No. 2,595,282 into the ladle after it is filled with the molten metal, while in other cases the container filled with the treating agent is placed and attached to, U.S. Pat. No. 3,934,862, or near, U.S. Pat. No. 3,942,775 the ladle bottom prior to the filling of the ladle.

In these cases, once the container melts, or disintegrates, the addition agent is exposed to the liquid steel, and, if the addition agent is lighter-than-steel, it quickly rises to the slag, and if the addition agent is calcium or magnesium flaring, metal eruption, and smoke result with a large portion of the calcium or magnesium being wasted to the slag and the atmosphere.

Experience teaches us that 'solid' shapes of pure magnesium or calcium can be submerged into high nickel alloys without these problems occuring, and small amounts of calcium can be submerged into iron with little difficulty. However, submersion of solid shapes of these elements into steel results in violent explosions when magnesium is added, and, severe metal eruptions and flaring when calcium is added. The difference noted in the activity of these elements in different steels and alloys is considered to be related to solubility differences, with their solubility in steel being the least.

For example, in the case of calcium, Sponseller, D. L., Trans Met Society AIME, Vol. 230, June 1964, shows its solubility to be very low in steel but increases substantially as the nickel or carbon content is increased.

Immediately upon calcium dissolving, it reacts with the impurities in the steel, which results in compounds that float to the surface of the steel thus removing the impurities from the molten steel.

Various methods have been used in molten iron to reduce this violent activity by slowly introducing magnesium metal into the iron under rigidly controlled systems. One of these methods for reducing the violence is to impregnate porous bodies with magnesium metal and to introduce these magnesium impregnated porous bodies into the molten ferrous metal. Under these conditions, the impregnated magnesium metal is released at a slow enough rate that the violence is held to a minimum.

Among the known porous bodies which have been used with some success for this purpose are porous coke, U.S. Pat. No. 3,321,304, carbon, graphite and ceramic bodies U.S. Pat. No. 4,083,716, such as quicklime, lump limestone or dolomite and the like.

In addition, magnesium has been infiltrated into porous iron bodies U.S. Pat. No. 3,902,892. Among these iron bodies is sponge iron in which the iron particles are very small and are sintered together to form a porous structure.

Another method mentioned as prior art in U.S. Pat. No. 3,902,892 is iron briquettes containing magnesium produced by dry pressing together iron particles and magnesium particles both of which preferably are from 4–60 mesh.

These methods, basically designed for magnesium inoculation, or, desulfurization of iron, are comparable to calcium treatment of iron. However, in all cases they are not suitable for use in steel for a number of reasons that include: the possibility of carbon pick-up from the coke; or the pick-up of exogenous inclusions from the ceramic bodies, or, hydrogen pick-up from the binders used in the castable ceramic bodies, etc., steel being more sensitive to these impurities than iron.

In addition there are limitations as to the chemical makeup of those products made with porous bodies since the amount of magnesium (or calcium) that these bodies can hold, depends upon the amount of porosity available in the bodies, or, in case of the ceramic bodies is limited to the amount of magnesium that the ceramic mix can hold and still be a castable ceramic. The specific chemical makeup is also limited to single elements, or, alloys, since the porous bodies must be submerged into a liquid bath of the element, or alloy, in order to fill the pores of the body. Mixtures of immiscible elements, therefore, cannot be used to fill the pores.

In addition, in the case of castable ceramics, elements that react with moisture, or with the binder, such as calcium, cannot be used because they would react with the moisture or the binder to destroy the strength of the casted shape, while the calcium would be partially or wholly consumed by the reaction.

In the case of pressed together briquettes of iron and magnesium (calcium), when these are added to liquid steel via normal tap stream addition methods, large quantities of smoke and flare develop with most of the magnesium (calcium) reacting with the slag or the atmosphere. When such material is packed into a sealed steel cylinder and the cylinder containing the briquettes is submerged into a filled ladle of steel, the cylinder melts exposing the briquettes all at one time. The briquettes, being lighter than the steel, quickly float to the surface causing flaring and smoke as they reach the surface of the steel, resulting in most of the magnesium (calcium) being wasted to the slag and atmosphere.

This invention, which is the submersion of, and the holding near the bottom of the liquid bath until dissolved, a soluble pressed together solid material of a particular percentage of active scavenging material that has been adjusted to, and balanced with, the dimension of said solid material in order to provide, and replace as it is being consumed, the maximum amount of active material that the steel will take, is not restricted by the aforementioned limitations, and thus the invention provides a more flexible, efficient smoke eliminating method for adding active, volatile, lighter-than-steel, additives that reduces and prevents air pollution.

To be more specific this invention is characterized by: the submersion of a solid material containing an active treating agent, not a treating agent in fine grain particulate form, into molten steel; being a mixture, and not an alloy, of at least two pressed together materials and as such can be made up of any conceivable composition, with the composition being easily controlled so as to prevent the addition of undesirable elements into the steel; shapes much larger than briquettes such as to provide the means of properly holding the additive submerged while it is being dissolved in the steel at a reduced melting rate necessary for optimum release of the calcium into the steel.

PURPOSE OF THE INVENTION

Additives such as calcium and its alloys or mixtures when added to molten steel by normal means cause intense heat, flaring and large volumes of smoke such that at times the whole melt shop can be filled with irritating smoke. The blinding flare and smoke is due to the greater percentage of the calcium reacting with the oxygen in the atmosphere, rather than with the impurities in the steel, resulting in very poor utilization of the calcium.

If these additions are made by a simple submersion technique dangerous molten metal eruptions occur with flaring and smoke.

The primary purpose of this invention is to provide a safe means of adding calcium with little or no smoke.

The secondary purposes are to add calcium to molten steel in a more effective, efficient, cost-effective way without the need for capital equipment for the user.

SUMMARY OF THE INVENTION

I have found that an active substance capable of combining with dissolved impurities such as calcium can be more effectively, safely, efficiently added and with little or no flare and smoke via a submersion method if the calcium is added at the maximum amount that does not exceed its solubility limit in the molten steel, and that as the calcium is consumed, it is replaced at the maximum RATE that does not exceed its CONSUMPTION RATE and SOLUBILITY LIMIT.

I have found that this RATE can be controlled by mixing the active agent, which is an active element and by definition is an additive that would normally cause the liquid steel to churn, boil, and erupt if submerged into molten steel, with at least one other inactive material which does not cause activity in the molten steel, in the proper formulation, and, pressing this mixture into a solid body of pressed together material of the appropriate surface area dimensions, such that upon submersion of said solid material into molten steel and holding near the bottom of the molten bath until dissolved, the desired amount of calcium is released into the steel in the required minimum time span, which is dependent upon the dissolution time of the solid material, necessary to insure complete consumption of the calcium addition by the steel. The optimum time frame can be calculated using known solubility limits and consumption rates for the active agent.

By controlling the rate at which the calcium is released into the molten steel so that the solubility limit is never exceeded, excess calcium is not available to vaporize in the steel to cause explosions or to rise to the metal surface to react with the slag or air to cause flaring and air pollution. Thus the explosions, flareups or air pollution, indicative of other adding methods are reduced and eliminated with this method.

This controlled release of the calcium into the steel results in more efficient utilization of the active agent or scavenging material since none of it floats to the slag to be wasted by the slag or by the oxygen in the air.

DESCRIPTION OF THE PREFERRED EMBODIMENT

The steel which is dealt with herein is usually low carbon steel, containing carbon from 0.03% to 0.20%, medium carbon steel containing 0.20% to 0.50%, or high carbon steel containing 0.50% and higher carbon. In some cases the steel may contain chromium from 0 to 65% and in some cases may contain nickel and/or cobalt up to 55%. It is found that deoxidation, desulfurization, dephosphorization often referred to as scavenging which is the subject of this invention is most useful in the carbon steels or steels above enumerated. In high nickel alloys the solubility of the active agent is much greater and therefore addition problems are non-existent and as such this method is not as important in these types of alloys.

Steels generally have certain impurities which it is desirous to remove. These impurities may be oxygen, sulfur, phosphorous, and oxides of silicon, manganese, and others.

The invention is based upon the need for a simple, smoke-free way to add active agents to molten steel for reducing impurities therein.

Although the invention is applicable to elemental or alloyed calcium, elemental or alloyed magnesium and possibly elemental or alloyed rare earths which are the active agents for reducing impurities in steel, the invention hereinafter will be described with reference to calcium due to its particular importance in steel making today.

Adding calcium to steel in the normal way, i.e. via tap stream additions, as shown by example 1, results in flaring and voluminous smoke.

EXAMPLE 1

Heat Size: 40 ton

Addition: 5 lbs calcium per ton of steel.

Addition Method: Total addition added to the tap stream in five cloth bags.

Result: Blinding & intensely hot flaring, and, voluminous smoke that filled the melt shop for 3 to 5 minutes before it all rose to the melt shop roof, and out through the louvers to be carried away by the wind to the surrounding community.

Benefit: Man hours required to remove defects from the surface of the 5×5 billets were reduced by 40%.

During my past experience, I have learned that submersion of calcium and calcium alloys, provides one of the best ways of adding calcium to steel. However, surprisingly, I have learned that while using simple submersion techniques calcium activity ranges from near explosive, Example 2, to calm, depending upon the steel or alloy being treated.

EXAMPLE 2

Heat Size: 40 Ton

Addition: 1¼ lb calcium per ton of steel.

Addition Method: One piece, weighing 50 lbs, by 12" Dia.×12" high was mounted on a steel pole and subsequently submerged into the ladle of steel.

Result: 1½ minutes after the solid piece of calcium was submerged into the ladle, a flare extending the full dia. of the ladle and twice as high suddenly developed with spurts of metal eruptions as high as two feet and over the sides of the ladle wall.

Fortunately, I have also learned that when the desired amount of calcium is added in several submersion increments instead of in one submersion addition, the activity is reduced substantially, and the near explosive conditions are reduced to tolerable metal splashing while at the same time the effectiveness of the calcium is increased and the amount of smoke evolved is somewhat reduced.

However, adding several submersion additions to large ladles of tonnage steel is impractical from an operations point of view.

In this invention I learned that a single submersion addition, Example 3 can replace several small submersion additions of calcium, to have the same or better end-effect providing (1) the calcium is mixed with iron and then formed into a solid pressed together material, and, (2) the calcium percentage of the resultant additive is carefully selected and balanced with the melting, or dissolution time of the solid additive itself in such a manner that there is sufficient time for the calcium to be totally absorbed and consumed by the steel as the additive dissolves, so that virtually none of the calcium is available to vaporize and rush to the surface of the molten steel to cause metal splashing, and to react with the air to cause smoke and air pollution.

EXAMPLE 3 (The Invention)

Heat Size: 40 Ton.

Addition: 1¼ lb of calcium per ton of steel as contained in a CaFe billet with 20% calcium.

Addition Method: 1 piece of CaFe billet weighing approximately 250 lbs.×9" dia×30 inches was submerged into the ladle of molten steel.

Result: No flaring, metal eruption, or smoke was observed.

Benefit: Man hours saved in surface conditioning of 5×5" billets was comparable to a 5 lb calcium per ton tap stream addition.

Example 1, illustrates the problems associated with adding calcium, and calcium additives to the tapping stream. Because of the smoke accompanying such additions, EPA and OSHA restrictions tend to limit and in some cases stop calcium additions entirely causing the steel maker to lose the cost and quality benefits of calcium additives.

Example 2 shows that simple submersion techniques are not applicable to calcium additions to steel and indeed can be unsafe.

Example 3 illustrates that a properly formulated solid mixture can be submerged safely in molten steel without the problems of flaring, metal eruption and smoke, and that such an addition can be more efficient since a 1¼ lb calcium/ton addition via a CaFe billet produces comparable effects upon the steel as tap stream additions using 5 lbs. of calcium/ton of steel.

The product of this invention is characterized by a consumable body of pressed together material consisting of calcium and at least one other material. The shape and composition of the pressed together material is balanced so as to provide a controlled release of calcium as the shape dissolves into the molten steel. The time for dissolution of the shape being dependent upon the surface area or dimension of the shape selected. To illustrate this effect more fully, I have listed in seven columns of Table I relevant data of different cylindrical shapes of CaFe pressed together material showing how melting time is effected by dimensional changes.

TABLE I

Relationship Between Billet Dimensions, Surface Area and Melting Time for 20% Calcium Billet

| $D_1$ (") | $D_2$ (") | h (") | Wt. (lb.) | Surface Area | S.A./Wt | Melt time (min.) |
|---|---|---|---|---|---|---|
| 8.5 | 1.75 | 30.75 | 230 | 923 | 3.9 | 7.0 |
| 12 | 2.75 | 20 | 304 | 968 | 3.2 | 8.59 |
| 10 | 2.75 | 29.5 | 304 | 1,072 | 3.5 | 7.76 |
| 8 | 2.75 | 48.5 | 304 | 1,308 | 4.3 | 6.36 |
| 6 | 2.75 | 96.0 | 304 | 1,854 | 6.1 | 4.49 |
| 4 | 2.75 | 323.0 | 304 | 4,072 | 13.4 | 2.04 |
| 3 | 2.75 | 1900.0 | 304 | 17,909 | 58.9 | 0.47 |

$D_1$ is the outside diameter of the cylinder in inches.
$D_2$ is the inside diameter of the hole in the cylinder in inches.
h is the height of cylinder in inches.
Column 4 is the weight of the billet in pounds.
Column 5 is the surface area.
Column 6 is the surface area/billet weight.
Column 7 is the melting time in minutes.

Thus, when one wishes to add a certain percentage of calcium to a ladle of steel, a composition and billet size is selected that will provide the desired amount of calcium for the dissolution, or melting time required to insure complete consumption by the steel.

The data for the above Table was developed using the fact that for a given mass, the melting rate is inversely related to the Surface Area that is exposed to the molten steel, and this can be represented by a simple equation:

$X=k(1/Y)$

X=melting time for cylinder.
k=a constant.
Y=Surface Area/Weight.
k is determined using the impirical data derived from the 8½ inch diameter billet, i.e. 27.36.

This addition method, being an improvement over the technique of submersing a desired calcium addition via several independent submersions, is more practical for use in large ladles of tonnage steels. The rate of calcium released into the steel is controlled to that rate at which the calcium can be consumed by the steel. This rate can be estimated using the following formula:

$$\frac{\text{Ca Solubility Limit in Particular Steel}}{\text{180 Sec (time req'd for Ca to dissolve \& react)}} \quad \text{(Eq. 1)}$$

The body of pressed together material is made by pressing together small particles of a non active material such as iron powder and active metal particles, such as Ca, at pressures up to 60,000 psi into a solid form that is 75% to 100% theorectical density. A currently preferred density range is between 87 and 93% theorectical. Although the particle size is not critical, a range of 100 to 8 mesh is preferred due to the better availability of such particle sizes. The form chosen to be most practical for manufacture and use is a cylinder of 9 or 12" dia. with a 2 to 8 inch axial hole extending the full length of the cylinder. The hole is used to position the cylinder on one end of a refractory covered stopper rod. The other end of the rod being firmly attached to a 'counter weight' of sufficient magnitude to keep the light cylinder near the bottom of the filled ladle. Using the stopper rod assembly that is properly counter weighted, the cylinder is submerged into a ladle of molten steel so that the cylinder comes to rest at a position close to the ladle bottom. Positioning the assembly before tap is also feasible. As the molten steel comes into contact with the cylinder, the cylinder is heated up to its melting point and it begins to dissolve into the molten steel releasing the calcium at a controlled rate depending upon the melting time of the cylinder itself.

As the calcium dissolves into the molten steel, a reaction takes place with the impurities combining therewith and the resultant products-of-reaction being lighter than the steel, float to the surface of the molten steel and into the slag. The total time necessary for the 'dissolved' calcium to react and the resultant products-of-reaction to rise to the slag, is estimated by Wahlster, Radex-Rundschau, 1969, pp 478–494, at approximately 180 seconds. By using: (1) a properly selected calcium percentage for the make-up of the cylinder to provide the desired amount of calcium addition, and, (2) the proper cylindrical dimensions, to provide the surface area to control the 'time' for dissolution of the cylinder, and, thus the simultaneous release of the calcium during this time frame; the RATE of calcium released into the steel is thereby carefully controlled. By adjusting the calcium percentage in a given size billet to obtain the maximum desired RATE, as determined by Equation 1, the calcium made available per minute is thereby controlled to (1) provide, on a continuing bases, sufficient calcium to replace that which is being consumed by its reaction with the impurities in the steel, and, at the same time, (2) limit the concentration of calcium in the steel so that at any given moment, it does not exceed its solubility limit. Thus all the calcium added is either in solution, or is consumed in the refining reaction, with none available to rise to the slag to cause explosions, flareups, or air pollution (smoke).

While the body of pressed together material may be in many various shapes, it is more convenient to provide a solid cylindrical form of the mixture with an axial hole through it for ease of implementation.

Iron is primarily used as the other ingredient of the composition for the cylindrical shape but in some cases the cylindrical form may be made up of active calcium and other inactive materials so as to better control the release of the calcium into the molten steel, or, to effect better deoxidation. These inactive materials may include Fe, Al, steel alloying elements, their oxides, CaO, $CaC_2$, CaF, Calcium Cyanamide and mixtures thereof. The calcium content itself can range from 1% to 99%, as can any of the other ingredients. These are pressed together with the calcium under such pressure that they are substantially bonded therewith and may be introduced into the molten steel either by (1) submersion and suspension of the cylinder into the steel, or, (2) the cylinder being rigidly suspended and the ladle of molten steel raised about the cylinder, or, (3) the slow immersion of the product into a shallow bath, such as into a tundish.

The active material which I use is primarily calcium metal, but commercially available calcium alloys, such as CaSi, CaMnSi, CaSiBa, CaSiBaAl, $CaC_2$, CaAl, and the like can be used in part or wholly as the calcium source for the cylinder.

Submersion of calcium and calcium additives via the described invention not only provides a way of reducing and eliminating the blinding flare and the polluting smoke that accompanies its normal tap stream addition but it provides a cheaper way for treating steel with calcium via substantially increasing the efficiency of the calcium addition.

For example, normal tap stream additions of calcium result in 3 to 5% recovery with most of the calcium reacting with the air. This invention, forces all the calcium to react with the steel and thereby prevents its reaction with the air, and, as such can increase calcium's efficiency as much as 20 fold. Therefore even though the forming of this product into the desired shape produces a more expensive product, the cost benefits, due to increased efficiency, overshadows the product cost to provide a cheaper way of treating steel with calcium.

In addition, the invention only requires a counter weight to hold the cylinder deep in the molten steel and perhaps a couple of 'I' beams placed in a horizontal position to the stopper rod assembly in order to rest the assembly on the ladle side walls, and, as such no capital investment is required to use this invention.

The billet as stated above may be of various shapes but more conveniently cylindrical and for greater shelf life may be encapsulated either fully or partly with steel, aluminum, iron, steel, copper or other metals for this purpose.

I claim:

1. A method of refining steel characterized by a safer more effective and efficient adding of an active elemental or alloyed substance capable of combining with the dissolved impurities for the primary purpose of reducing or eliminating the voluminous polluting smoke that is normally associated with such additions which method comprises the placement upon the end of a refractory covered vertical rod, a consummable solid body of a pressed together mixture of materials comprising an active substance which has a limited solubility in the steel and an inactive material or mixtures of inactive material selected from the group consisting of iron, aluminum, elements which will alloy with the steel and oxides thereof, so that upon effecting an immersion of the subsequent assembly into a deep molten steel pool and the holding in place thereof, the pressed together shape dissolves, with the rate of dissolution being controlled to within desired limits by the appropriate choice of the composition and dimensional shape of the solid body, resulting in the composition and the shape of the solid body providing a means by which a given amount of active substance can be added to the molten steel at a rate that does not allow the active substance to exceed its solubility limit in the steel and thus prevent any active substance from reaching the surface to react with the air to cause air pollution.

2. The method of claim 1, wherein the solid body of pressed together material is in cylindrical form.

3. The method of claim 1, wherein the solid body of pressed together material is in cylindrical form having an axial opening therein.

4. The method of claim 1, wherein the composition of the solid body of pressed together material can range between 1 and 99% calcium.

5. The method of claim 1, wherein the composition of the solid body of pressed together material has a theoretical density of 75 to 100%.

6. The method of claim 1, wherein the composition of the solid body of pressed together material has a theoretical density of 87 to 93%.

7. A method for adding calcium into molten steel via a safe, simple, efficient, smoke eliminating, submersion technique, comprising submersing and holding submerged until dissolved, a consummable, solid body of pressed together material consisting of active calcium and at least one inactive material, with the surface area of the solid body being chosen to meet a desired finite dissolution time, and the calcium percentage of the body being adjusted, beforehand, such as to allow a desired amount of calcium to become available to the steel as the body of pressed together calcium and inactive material dissolves, the surface area of the solid body, and, the calcium percentage of the body, being selected to provide the maximum rate at which calcium can be made available to the molten steel, that will: (1) on a continuing bases, replace the calcium that is being consumed by the impurities in the steel; while, at the same time, (2) not allow the concentration of calcium in the steel bath to exceed its solubility limit at any time to provide a more smoke-free, efficient calcium addition.

8. The method of claim 7 wherein the material used with calcium consists of one or more of the following: Al, Fe, their oxides, CaO, $CaC_2$, CaF, Calcium Cyanamide, steel alloying elements and mixtures thereof.

9. The method of claim 7 wherein calcium is replaced by magnesium.

10. The method of claim 1 wherein the body of pressed together material is at least partly encapsulated with steel, aluminum, or copper for the purpose of providing longer shelf life.

11. The method of claim 7 wherein the pressed together body is 20% calcium and 80% steel (Fe).

12. The method of claim 7 wherein the pressed together body is 20% calcium and 80% steel (Fe) and is a cylindrical shape with an axial hole.

13. A method of reducing impurities in steel by a more efficient adding of an elemental or alloyed material capable of combining with the dissolved impurities in the steel for (1) lowering the impurities such as oxygen, sulfur, and the like, and (2) reducing or eliminating the smoke that normally accompanies such additions which comprises adding to molten steel by submersing a consummable solid body of a pressed together mixture of materials comprising an active material which has a limited solubility in the steel and an inactive material or mixtures of inactive materials selected from the group consisting of iron, elements which will alloy with the steel, and oxides thereof, the composition of the solid body being adjusted to allow a precalculated controlled release of the active material into the liquid steel as the solid body dissolves providing a means by which a given amount of active material can be added to the molten steel at a rate that does not allow the active material to exceed its solubility limit in the steel.

14. The method of claim 13 wherein the inactive material may be selected from one or several of the following: iron, Al, elements which will alloy with the steel and/or oxides thereof.

15. The method of claim 13 wherein the solid body contains, for steel alloying purposes, one or several of the following: Al, Ba, Mn, Si, or mixtures thereof.

16. The method of claim 13 wherein the calcium content of the solid body is balanced against the surface area of the body to provide continuing release of calcium into the liquid steel as the body melts, the relationship being represented by the formula $$Ca^{①}/m.t.^{②} = \text{or less than } Ca^{③}/t^{④}$$

① Calcium in the FeCa (lbs)
② melting time of body=(k)*FeCa(lbs)/Surface Area ($in^2$)
③ solubility of Calcium in particular steel
④ Minimum time reg'd for Calcium consumption
*k for carbon steel determined to be 27.36±10%.

17. The method of claim 1 wherein the refractory covered metal is actually the stopper rod used for teeming.

18. The method of claim 1 wherein the solid body contains, for steel alloying or deoxidation purposes, one or several of the following: Al, Ba, Mn, Si, alloys, or mixtures thereof.

19. The method of claim 7 wherein the pressed together body is 20% calcium and 80% steel (Fe).

20. A method of claim 7 wherein the pressed together body is 20% calcium and 80% steel (Fe) and is a cylindrical shape with an axial hole.

* * * * *